US009879462B2

(12) United States Patent
Svara et al.

(10) Patent No.: US 9,879,462 B2
(45) Date of Patent: Jan. 30, 2018

(54) HINGE ASSEMBLIES

(71) Applicant: Lama D. D. Dekani, Dekani (SI)

(72) Inventors: Valter Svara, Izola (SI); Danijel Kozlovic, Dekani (SI); David Pecar, Pobegi (SI)

(73) Assignee: Lama D. D. Dekani, Dekani (SI)

( * ) Notice: Subject to any disclaimer, the term of this patent is extended or adjusted under 35 U.S.C. 154(b) by 0 days.

(21) Appl. No.: 14/436,218

(22) PCT Filed: Oct. 15, 2013

(86) PCT No.: PCT/EP2013/071522
§ 371 (c)(1),
(2) Date: Apr. 16, 2015

(87) PCT Pub. No.: WO2014/060410
PCT Pub. Date: Apr. 24, 2014

(65) Prior Publication Data

US 2015/0292252 A1 Oct. 15, 2015

(30) Foreign Application Priority Data

Oct. 16, 2012 (GB) ..... 1218563.3

(51) Int. Cl.

| | |
|---|---|
| ***E05F 5/10*** | (2006.01) |
| ***E05F 5/00*** | (2017.01) |
| ***E05D 3/12*** | (2006.01) |
| ***E05F 5/02*** | (2006.01) |

(52) U.S. Cl.
CPC ..... *E05F 5/10* (2013.01); *E05D 3/12* (2013.01); *E05F 5/006* (2013.01); *E05F 5/02* (2013.01); *E05Y 2201/21* (2013.01); *E05Y 2201/254* (2013.01); *E05Y 2201/264* (2013.01); *E05Y 2201/618* (2013.01); *E05Y 2201/638* (2013.01); *E05Y 2201/696* (2013.01); *E05Y 2900/20* (2013.01); *Y10T 16/304* (2015.01)

(58) Field of Classification Search
CPC .... E05F 5/02; E05F 5/10; E05F 5/006; E05D 7/086; E05D 3/12
See application file for complete search history.

(56) References Cited

U.S. PATENT DOCUMENTS

| | | | | |
|---|---|---|---|---|
| 5,269,043 A * | 12/1993 | Yang | ..... | E05F 5/006 16/68 |
| 7,395,580 B2 * | 7/2008 | Brustle | ..... | E05F 5/006 16/50 |
| 7,748,082 B2 * | 7/2010 | Harald | ..... | E05F 5/006 16/280 |

(Continued)

FOREIGN PATENT DOCUMENTS

| | | |
|---|---|---|
| GB | 2469847 A | 3/2010 |
| WO | WO2012002625 A1 | 1/2012 |

*Primary Examiner* — Jeffrey O Brien
(74) *Attorney, Agent, or Firm* — Alan D. Kamrath; Kamrath IP Lawfirm, P.A.

(57) ABSTRACT

A hinge assembly includes a toggle type hinge mechanism (10) with a linear damper (13) arranged with its longitudinal axis parallel to the axis of movement of the hinge mechanism. First and second wings (19, 30) operate the damper. First and second striker plates and an arm assembly (20, 32, 55) activate the first and second wings in response to movement of the hinge mechanism.

17 Claims, 2 Drawing Sheets

(56) References Cited

U.S. PATENT DOCUMENTS

| | | | | |
|---|---|---|---|---|
| 8,186,014 | B2 * | 5/2012 | Pecar | E05D 3/142 16/286 |
| 8,561,765 | B2 * | 10/2013 | Chen | E05F 5/02 16/50 |
| 8,640,305 | B2 | 2/2014 | Pecar et al. | |
| 9,003,605 | B2 * | 4/2015 | Pecar | E05F 5/006 16/286 |
| 2008/0209674 | A1 * | 9/2008 | Harald | E05F 5/006 16/82 |
| 2009/0119875 | A1 * | 5/2009 | Migli | E05F 5/006 16/233 |
| 2013/0113355 | A1 * | 5/2013 | Salice | E05F 5/006 312/326 |
| 2016/0024829 | A1 * | 1/2016 | Lowe | E05F 5/006 16/85 |
| 2016/0138319 | A1 * | 5/2016 | Wu | E05F 3/20 16/50 |
| 2016/0153224 | A1 * | 6/2016 | Salice | E05D 3/16 16/52 |

* cited by examiner

HINGE ASSEMBLIES

This invention relates to hinge and damper assemblies and, more particularly, to hinge assemblies comprising toggle type hinges, of the sort that are typically used on kitchen cupboards, together with a damping device.

The invention provides a hinge assembly comprising a toggle type hinge, a linear damping device arranged with its longitudinal axis parallel to the axis of movement of the hinge, first and second actuating devices for operating the damping device, and means to activate the first and second actuating devices in response to movement of the hinge.

Figure 1:
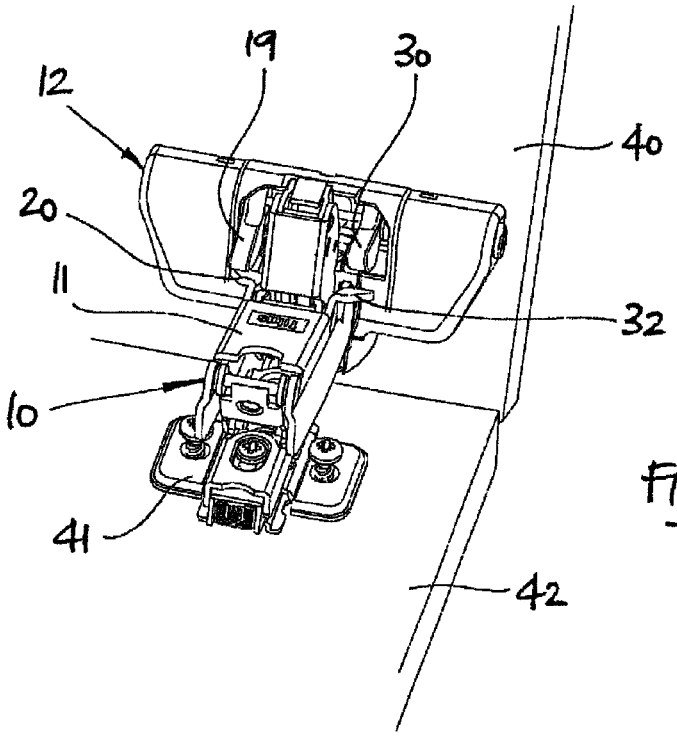
Figure 4:
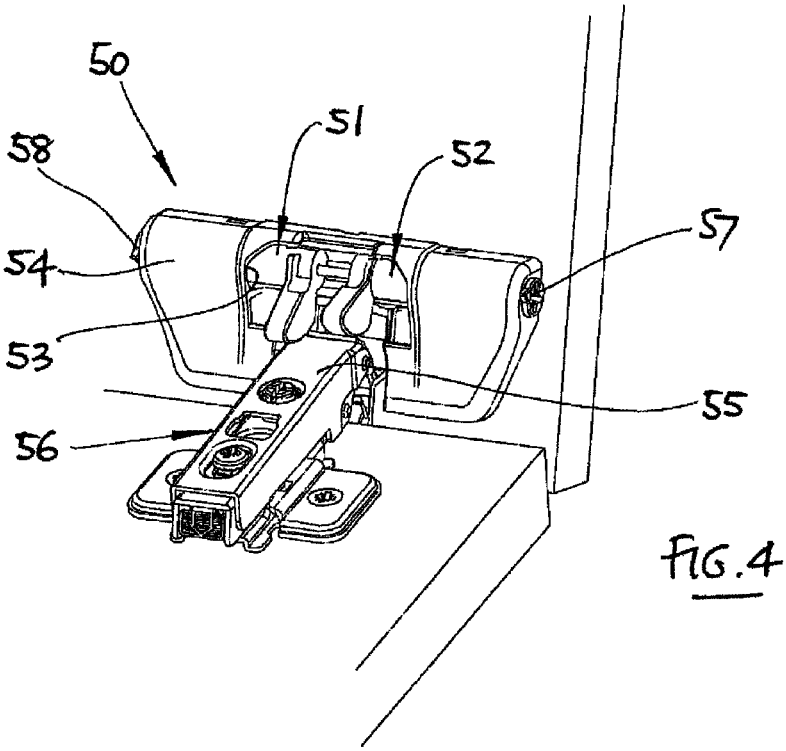
Figure 2:
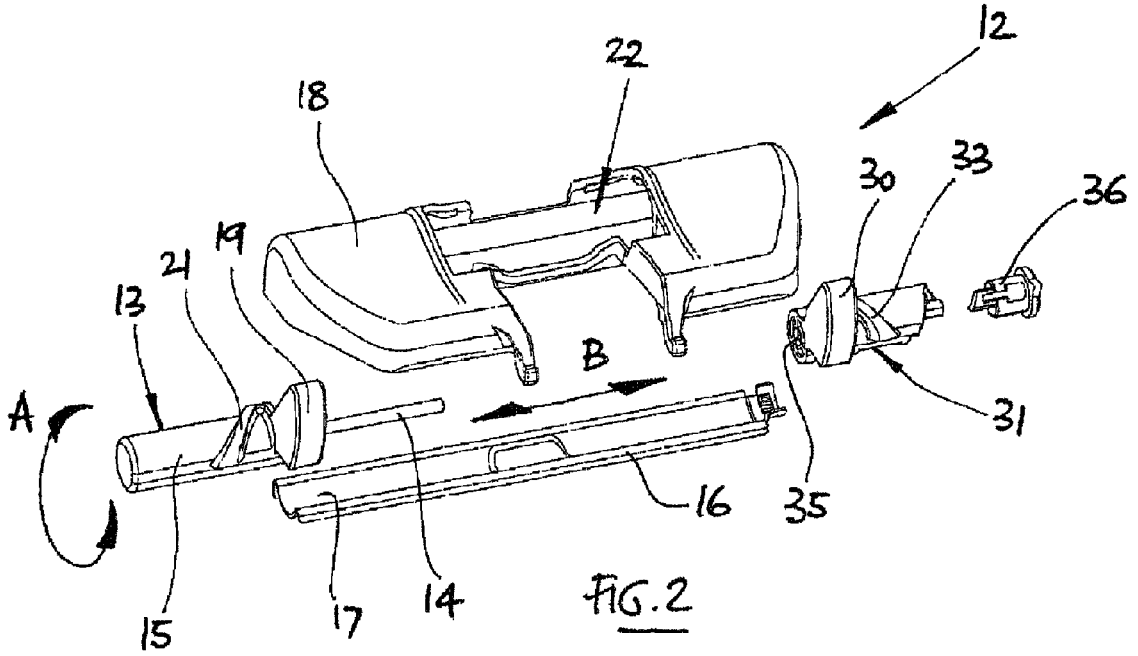
Figure 3:
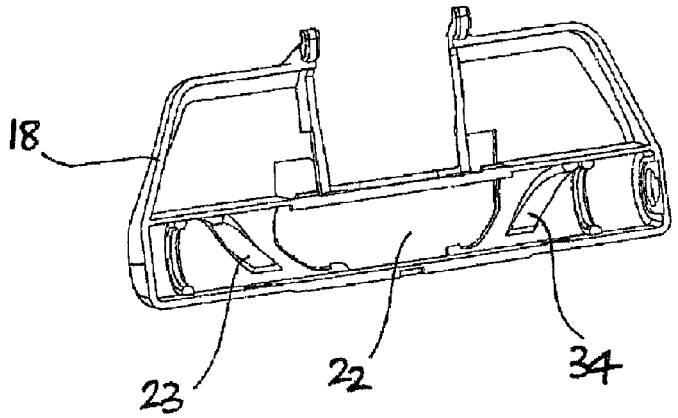

By way of example, embodiments of the invention will now be described with reference to the accompanying drawings, in which:

FIG. 1 shows a first form of hinge assembly according to the invention in use on a cupboard door, FIG. 2 is an exploded view showing the damper assembly of the hinge assembly of FIG. 1, FIG. 3 is an underneath view of the housing of the damper assembly of FIG. 2, and FIG. 4 shows a second form of hinge assembly according to the invention in use on a cupboard door.

The hinge assembly seen in FIG. 1 comprises a hinge mechanism 10 of the well known toggle-type construction for hanging a door, eg on a kitchen cupboard. Here, the hinge mechanism 10 is one that is designed to allow up to 170° of opening.

The hinge mechanism 10 comprises at one end a hinge cup flange (not seen in FIG. 1) to which a door 40 is mountable in known manner. At the other end, the hinge mechanism 10 comprises an adjustable anchorage 41 by which it is mountable onto a cupboard carcase 42 in known manner. In between, the hinge mechanism 10 comprises a multi-link arm assembly 11 which constitutes a compound linkage by which the door 40 is pivotably mounted on the cupboard carcase 42.

The hinge assembly also comprises a damper assembly 12 to interact with the hinge mechanism 10. The damper assembly 12 is mounted on the hinge cup flange, here by means of a snap-fit connection.

As seen in FIG. 2, the damper assembly 12 comprises a damper 13. The damper 13 is in the form of a linear damper with a piston (not seen) arranged on a piston rod 14 for reciprocal movement in a damping medium such as silicone contained within a cylinder 15, with a spring (not seen) normally biasing the piston towards the extended position of the piston rod. The damper 13 is mounted by its cylinder 15 on a guide plate 16 with a radiused groove 17 and is held in position by a housing 18. The manner of mounting of the damper 13 means that its cylinder 15 is able to rotate about its longitudinal axis, with this manner of movement being indicated by arrow A in FIG. 2. It is also able to move axially, with this manner of movement being indicated by arrow B in FIG. 2.

The hinge assembly further comprises two actuating devices. The first actuating device comprises a wing 19 which extends laterally out from the cylinder 15. The wing 19 is designed to protrude through an opening 22 in the housing 18 to be engagable with the hinge mechanism 10. Specifically, the wing 19 is designed to engage a striker plate 20 which extends laterally from the arm assembly 11, as seen in FIG. 1. The wing 19 makes sliding contact with its striker plate 20 and its contact surface is contoured to act as a camming mechanism. In particular, the arrangement is such that in the closing movement of the door 40, the striker plate 20 will engage the wing 19, and as the door continues to close, the cylinder 15 will be caused to rotate by the camming action between the striker plate and the wing.

The first actuating device also includes an external rib 21 that is arranged to extend part way around the circumference of the cylinder 15 in a helical path. The housing 18 is provided with a corresponding rib 23 on its inner surface (see FIG. 3) which has a helical path corresponding to that of the rib 21 on the cylinder 15. The two ribs 21 and 23 are designed to interengage in an axially abutting relationship (under the action of the spring in the damper) when the damper 13 is mounted in position between the guide plate 16 and the housing 18. The effect of this arrangement is that rotation of the cylinder 15 about its longitudinal axis (arrow A) will cause a corresponding linear displacement of the cylinder 15 (arrow B) as a result of the camming action between the two helically extending ribs 21 and 23. The axial displacement thus generated is arranged to cause compression of the damper 13 and hence provide a damped resistive force to the rotational movement of the cylinder 15. This force is in turn transmitted via the wing 19 to the striker plate 20 and hence to the door 40 to damp its closing movement.

In this embodiment, the first actuating device is provided as an integral part of the damper construction. However, it could instead be provided as a separate element and be designed to receive a standard damper.

The second actuating device is in the form of a generally cylindrical body 31 from which a wing 30 extends laterally out. Like the first actuating device, the body 31 is mountable in the radiused groove 17 in the guide plate 16 for rotation about its longitudinal axis (arrow A) and for axial movement (arrow B). The wing 30 is arranged to protrude through the opening 22 in the housing 18 in order to engage the hinge mechanism 10. Specifically, the wing 30 is designed to engage a second striker plate 32 which extends laterally from the arm assembly 11. As seen in FIG. 1, the striker plates 20 and 32 are arranged to extend out to either side of the arm assembly 11.

The wing 30 makes sliding contact with its striker plate 32 and its contact surface is contoured to act as a caroming mechanism. In particular, the interengagement between the wing 30 and its striker plate 32 is such that in the closing movement of the door 40, the actuator body 31 will be caused to rotate by the camming action between striker plate and the wing.

The second actuating device also includes an external rib 33 that extends part way around the outer circumference of the actuator body 31 in a helical path. The housing 18 is provided with a corresponding rib 34 on its inner surface (see FIG. 3), which has a helical path corresponding to the rib 33 on the actuator body 31. The two ribs 33 and 34 are designed to interengage in an axially abutting relationship (also under the action of the spring in the damper) when the actuator body 31 is mounted in position between the guide plate 16 and the housing 18. The effect of this arrangement is that when the actuator body 31 is rotated about its longitudinal axis (arrow A), the camming action of the two helically extending ribs 33 and 34 will cause an axial displacement of the actuator body (arrow B).

The guide plate 16 with its radiused groove 17 is arranged to be mountable on the hinge cup flange of the hinge assembly by suitable means. Alternatively, the radiused groove 17 could be provided as an integral part of the hinge cup flange itself.

The helically extending ribs 23, 34 arranged in the housing 18 could instead be provided on the guide plate 16, or even as an integral part of the hinge cup flange. Furthermore, instead of using interengaging abutting ribs as a mechanism for converting rotary motion into linear motion, it would be possible instead to use a rib and groove arrangement. The rib would be provided on one of the elements, whilst a corresponding groove to engage the rib would be provided on the other element.

The actuator body 31 is aligned with the damper 13 so that it acts as an abutment for the free end of the piston rod 14, having a seat 35 for this purpose. An adjustable end stop 36 is mounted in the housing 18 to allow for axial adjustment of the position of the actuator body 31.

The axial displacement of the actuator body 31 generated by movement of the hinge is arranged to cause compression of the damper 13. The compressing action of the second actuating device will be supplementary to the compressing action of the first actuating device described earlier. The two actuating devices thus operate together on the damping device from opposite directions. They also effectively act independently of each other, since each has its own activating mechanism.

One of the advantages of this arrangement is that the helical paths of the two actuating devices can be designed with much smaller pitches, ie lower gearing, than would be the case with just a single actuating device acting on the damper, for the same amount of travel. This is advantageous, because it means that in operation the radial component of the force transmitted by movement of the hinge onto the damper assembly will be significantly less. There will therefore be less tendency for the housing to deform or possibly burst open.

The amount of damping force generated by a linear piston and cylinder damper is essentially proportional to its rate of compression: the higher the rate of compression, the higher the damped resistance. Having two independently acting actuating devices thus enables a wide range of adjustment in terms of tailoring the damping characteristics of the hinge assembly. Firstly, it is possible to arrange for the two striker plates to come into engagement with their respective actuating devices at different stages of the closing movement of the hinge, eg for one of the devices to operate before the other. The adjustable end stop in the housing allows for adjustment of this. If one of the actuating devices initially acts alone, this would give a relatively "soft" damping response to movement of the hinge. When the other actuating device kicks in, however, the result is an increased or "harder" damping response to the hinge movement. This helps to avoid the problem of door bounce in a slam test.

The actuating devices could also be arranged to act over different ranges of movement of the hinge and/or at different rates. This sort of adjustment could be achieved by altering the pitch and/or profile of their respective helical paths.

The double acting damper actuation mechanism described above can be applied to different hinge assemblies. As an example, a second form of hinge assembly is seen in FIG. 4. In this embodiment, the hinge is again a toggle type hinge, but one with a standard 90° opening. Again, the damping mechanism 50 is designed to be attachable by suitable means to the hinge cup flange (not seen) of the hinge assembly. The wings of first and second actuating devices 51, 52 can be seen protruding out of an opening 53 in the housing 54. In this case, the wings of the actuating devices 51, 52 are designed to engage the arm assembly 55 of the hinge mechanism 56 on the closing movement of the door.

As with the assembly described above, the two actuating devices each comprise a mechanism for converting rotary motion into linear motion so that the closing movement of the door will cause the two actuating devices to move towards each other, thus compressing the damping device and creating the damped resistance to the closure. It will be seen that the wings of the two actuating devices 51, 52 are spaced apart in the open position of the door: this is to allow for their movement towards each other in the door closing cycle. The wings make sliding contact with the arm assembly 55, initially towards its outer edges, but moving towards its midpoint as the door closes. The width of the arm assembly 55 in a standard hinge of this nature provides enough room for travel of the actuating devices 51, 52, and hence enough compression of the damping device, to provide a suitable damped resistive force to the closing of the door.

The assembly seen in FIG. 4 has all of the degrees of adjustability as the embodiments described earlier, including adjustable end stops 57 and 58 for adjusting the position of the actuating devices 51 and 52 within the housing 54.

In the embodiments described above, the actuating devices incorporate mechanisms for converting rotary motion into linear motion. These include cams with a helically extending path and in the examples shown, take the form of interengaging ribs and/or interengaging ribs and grooves. Such arrangements are fine where the helical path is to be of constant pitch. However, there might be occasions where it is helpful for one or both of the movement converting mechanisms to have a variable pitch. A variable pitch would enable the rate of linear displacement of the actuating mechanism to be variable over the course of the closing movement of the door. This could be achieved, for example, by using a pin instead of a rib to engage the rib or helical groove. Since the amount of damping resistance produced by a linear damper is essentially proportional to its rate of compression, this would allow an additional degree of adjustment for tailoring the damping characteristics of a hinge assembly.

The invention claimed is:

1. A hinge assembly comprising: a toggle type hinge; a linear damping device arranged with a longitudinal axis parallel to an axis of movement of the toggle type hinge, wherein the damping device comprises a single piston rod reciprocally moveable in a damping medium contained within a single cylinder; a first actuating device operating the cylinder; a second actuating device operating the piston rod reciprocally moveable in the cylinder; means to activate the first and second actuating devices in response to movement of the toggle type hinge, wherein said first and second actuating devices operate the linear damping device at different rates; and a first axial end stop for adjusting an axial position along the longitudinal axis of one of the first and second actuating devices.

2. A hinge assembly as claimed in claim 1 wherein the first and second actuating devices operate the linear damping device in opposite directions.

3. A hinge assembly as claimed in claim 2 wherein the means to activate the first and second actuating devices operate independently of each other.

4. A hinge assembly as claimed in claim 3 wherein the first and second actuating devices operate the linear damping device over different ranges of movement of the toggle type hinge.

5. A hinge assembly as claimed in claim 4 wherein the means to activate the first and second actuating devices operate at different stages of the movement of the toggle type hinge.

6. A hinge assembly as claimed in claim 5 wherein the first and second actuating devices each incorporate a mechanism for converting rotary motion into linear motion.

7. A hinge assembly as claimed in claim 6 wherein each mechanism includes a cam with a helically extending path.

8. A hinge assembly as claimed in claim 7 wherein the helically extending path of the cam has a variable pitch.

9. A hinge assembly as claimed in claim 1 wherein the Means to activate the first and second actuating devices operate independently of each other.

10. A hinge assembly as claimed in claim 1 wherein the first and second actuating devices operate the linear damping device over different ranges of movement of the toggle type hinge.

11. A hinge assembly as claimed in claim 1 wherein the means to activate the first and second actuating devices operate at different stages of the movement of the toggle type hinge.

12. A hinge assembly as claimed in claim 1 wherein the first and second actuating devices each incorporate a mechanism for converting rotary motion into linear motion.

13. A hinge assembly as claimed in claim 12 wherein each mechanism includes a cam with a helically extending path.

14. A hinge assembly as claimed in claim 13 wherein the helically extending path of the cam has a variable pitch.

15. A hinge assembly as claimed in claim 1 wherein the means to activate the first and second actuating devices activates the first actuating device to operate the linear damping device alone followed by activating the second actuating device to operate the linear damping device.

16. A hinge assembly as claimed in claim 1 wherein the first adjustable end stop is mounted in a housing aligned with the one of the first and second actuating devices.

17. A hinge assembly as claimed in claim 1 further comprising a second adjustable end stop mounted in a housing aligned with the first and second actuating devices for adjusting an axial position along the longitudinal axis of another of the first and second actuating devices.

* * * * *